United States Patent [19]

Slattery et al.

[11] Patent Number: 4,487,015

[45] Date of Patent: Dec. 11, 1984

[54] MOUNTING ARRANGEMENTS FOR COMBUSTION EQUIPMENT

[75] Inventors: Sidney E. Slattery, Foston; Harry Henshaw, Duffield; Peter Havercroft, Weston on Trent, all of England

[73] Assignee: Rolls-Royce Limited, London, England

[21] Appl. No.: 470,546

[22] Filed: Feb. 28, 1983

[30] Foreign Application Priority Data

Mar. 20, 1982 [GB] United Kingdom ..... 8208227

[51] Int. Cl.[3] ..... F02C 7/20

[52] U.S. Cl. ..... 60/39.32; 60/751

[58] Field of Search ..... 60/39.31, 39.32, 751

[56] References Cited

U.S. PATENT DOCUMENTS

| | | | |
|---|---|---|---|
| 2,445,661 | 7/1948 | Constant et al. | 60/39.32 |
| 2,702,987 | 3/1955 | Nicolin | 60/39.32 |
| 2,801,520 | 8/1957 | Highberg | 60/39.32 |
| 3,186,168 | 6/1965 | Ormerod et al. | 60/39.32 |
| 3,394,543 | 7/1968 | Slattery | 60/751 X |
| 3,463,498 | 8/1969 | Bill | 60/39.32 |
| 3,670,497 | 6/1972 | Sheldon | 60/39.32 |
| 3,826,084 | 7/1974 | Branstrom et al. | 60/39.31 X |
| 4,177,637 | 12/1979 | Pask | 60/751 X |
| 4,191,011 | 3/1980 | Sweeney et al. | 60/39.32 |

FOREIGN PATENT DOCUMENTS

| | | | |
|---|---|---|---|
| 2036459 | 2/1971 | Fed. Rep. of Germany | 60/751 |
| 1578474 | 3/1977 | United Kingdom . | |

*Primary Examiner*—Louis J. Casaregola
*Assistant Examiner*—Jeffrey A. Simenauer
*Attorney, Agent, or Firm*—Cushman, Darby & Cushman

[57] ABSTRACT

The combustion equipment of a gas turbine engine comprises an annular flame tube and a support casing both subjected to relatively high temperatures. Engine acceleration or engine deceleration causes the temperature in the combustion equipment to increase or decrease respectively, and this results in either expansion or contraction of the annular flame tube and the support casing.

The annular flame tube has a greater rate of thermal expansion/contraction than that of the support casing and this results in distortion or cracking of the combustion equipment if the annular flame tube and support casing are rigidly mounted to each other.

To overcome this problem a relatively flexible support structure which has a generally U-shaped cross-section is positioned radially between the annular flame tube and the support casing, and a first limb of the flexible support structure is secured to the annular flame tube and a second limb of the flexible support structure is secured to the support casing, and the flexible support structure permits relative radial movement of the annular flame tube and the support casing.

4 Claims, 6 Drawing Figures

MOUNTING ARRANGEMENTS FOR COMBUSTION EQUIPMENT

The present invention relates to mounting arrangements for the combustion equipment of gas turbine engines. The invention is concerned with an arrangement for mounting an annular flame tube within a support casing spaced radially outboard of the annular flame tube.

The combustion equipment of a gas turbine engine is subjected to high temperatures and thermal stresses which vary due to the different engine operating conditions. During acceleration of the engine, the temperature in the combustion equipment increases and this causes the annular flame tube and the support casing to expand radially. Similarly during deceleration of the engine, the temperature in the combustion equipment decreases and this causes the annular flame tube and the outer casing to contract radially. The annular flame tube and the support casing have different rates of thermal radial expansion/contraction, and in combustion equipment in which the annular flame tube is rigidly mounted onto the support casing, this difference in the rates of thermal radial expansion/contraction introduces stresses into the annular flame tube and the support casing and can result in distortion or cracking of the annular flame tube or the support casing.

The present invention seeks to provide a mounting device for combustion equipment which will alleviate the problems of distortion and cracking in the annular flame tube and the support casing due to the difference in thermal radial expansion/contraction of the annular flame tube and the support casing.

Accordingly the present invention provides a combustion equipment mounting arrangement comprising an annular flame tube, a support casing which is spaced radially outboard of the annular flame tube, a relatively flexible support structure which is generally U-shaped in cross-section and is positioned radially between the annular flame tube and the support casing, a first limb of the flexible support structure is secured to the annular flame tube and a second limb of the flexible support structure is secured to the support casing, the flexible support structure permitting relative radial movement of the annular flame tube and the support casing..

The annular flame tube may be secured to the first limb of the flexible support structure by a number of struts which extend from the annular flame tube to an outer diffuser wall which is spaced radially outboard of the annular flame tube and is secured to the first limb of the flexible support structure.

The outer diffuser wall may be secured to a number of fairings which extend in a radial direction, each fairing being secured to the first limb of the flexible support structure.

The outer diffuser wall may be secured to a number of fairings which extend in a radial direction, each fairing extending through a slot in the first limb of the flexible support structure, the fairings not being secured to the first limb of the flexible support structure.

The fairings may be secured to the first limb of the flexible support structure at a position upstream of the position where the outer diffuser wall is secured to the first limb of the flexible support structure.

The downstream end of the outer diffuser wall may be secured to the downstream end of the first limb of the flexible support structure.

The downstream end of the outer diffuser wall may have an integral arm which extends in an upstream direction and is secured to the downstream end of the first limb of the flexible support structure.

The support casing may be secured to the second limb of the flexible support structure by a number of bolts which extend through respective bosses in the support casing and secure a burner to a respective burner mounting plate, the burner mounting plate being secured to the second limb of the flexible support structure.

The outer diffuser wall may be spaced radially inboard of the support casing.

The flexible support structure may be completely annular in section.

The invention will be more fully described with reference to the accompanying drawings in which.

Figure 2:
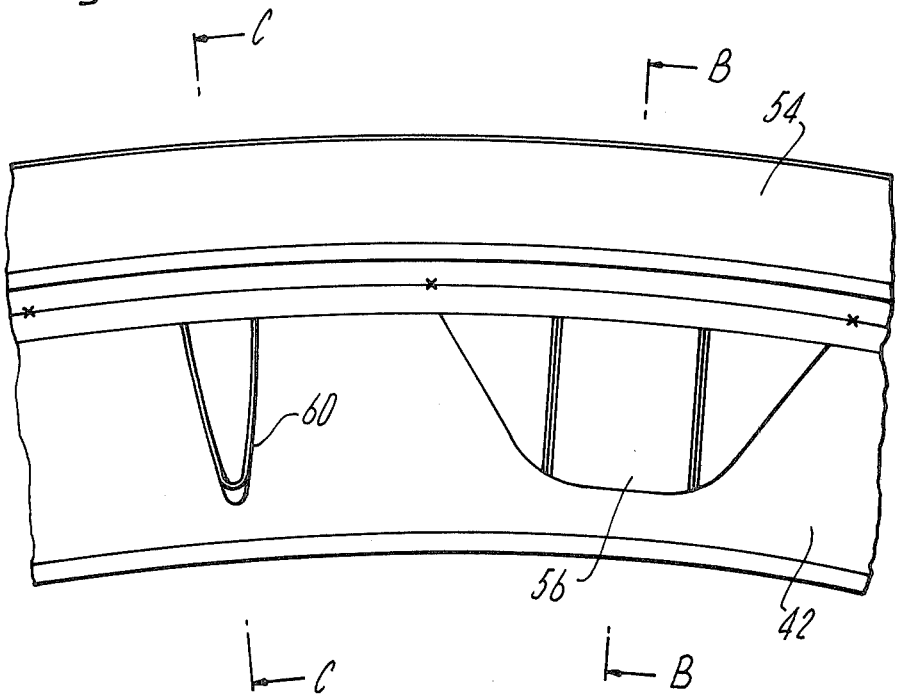
FIG. 2 is a view in the direction of arrow A in, FIG. 1 to an enlarged scale.
Figure 3:
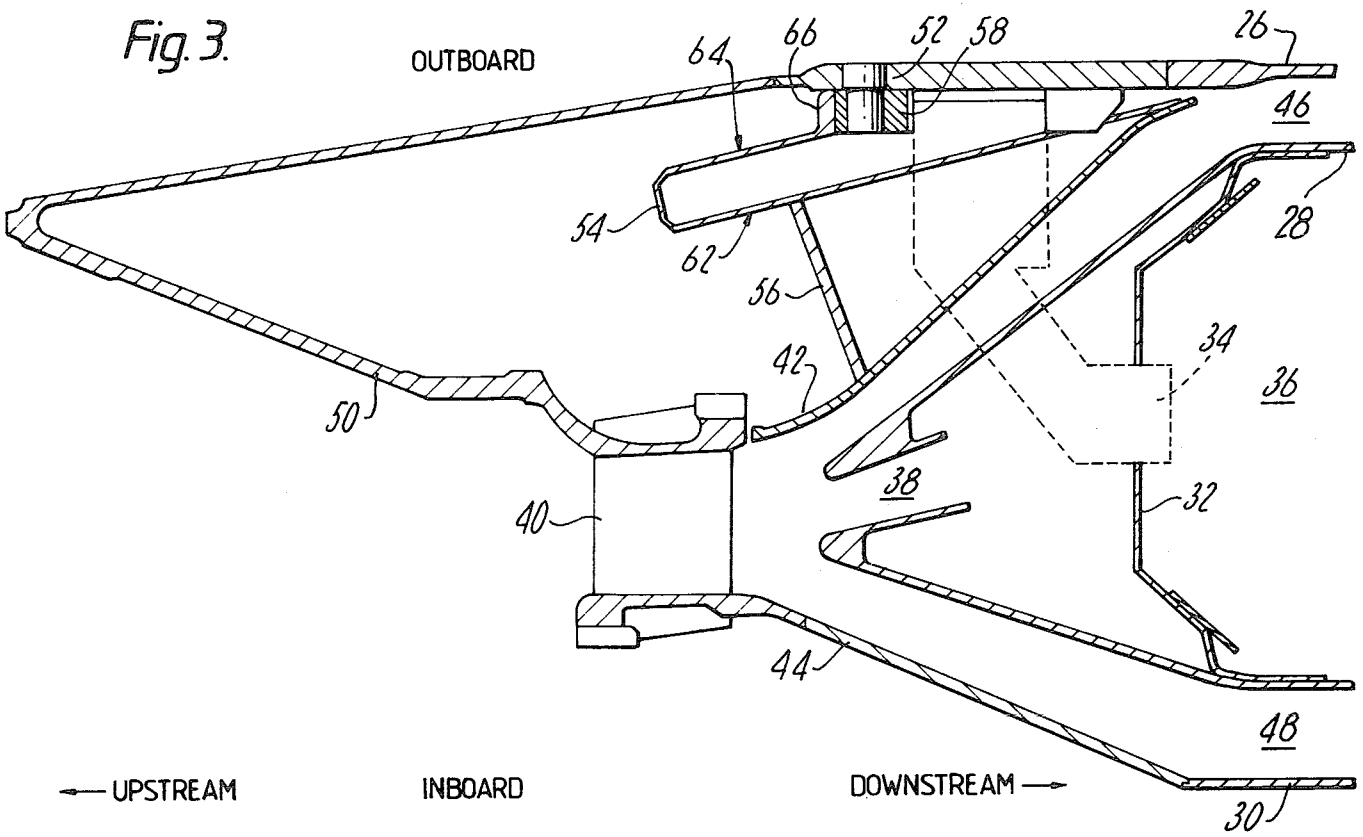
Figure 4:
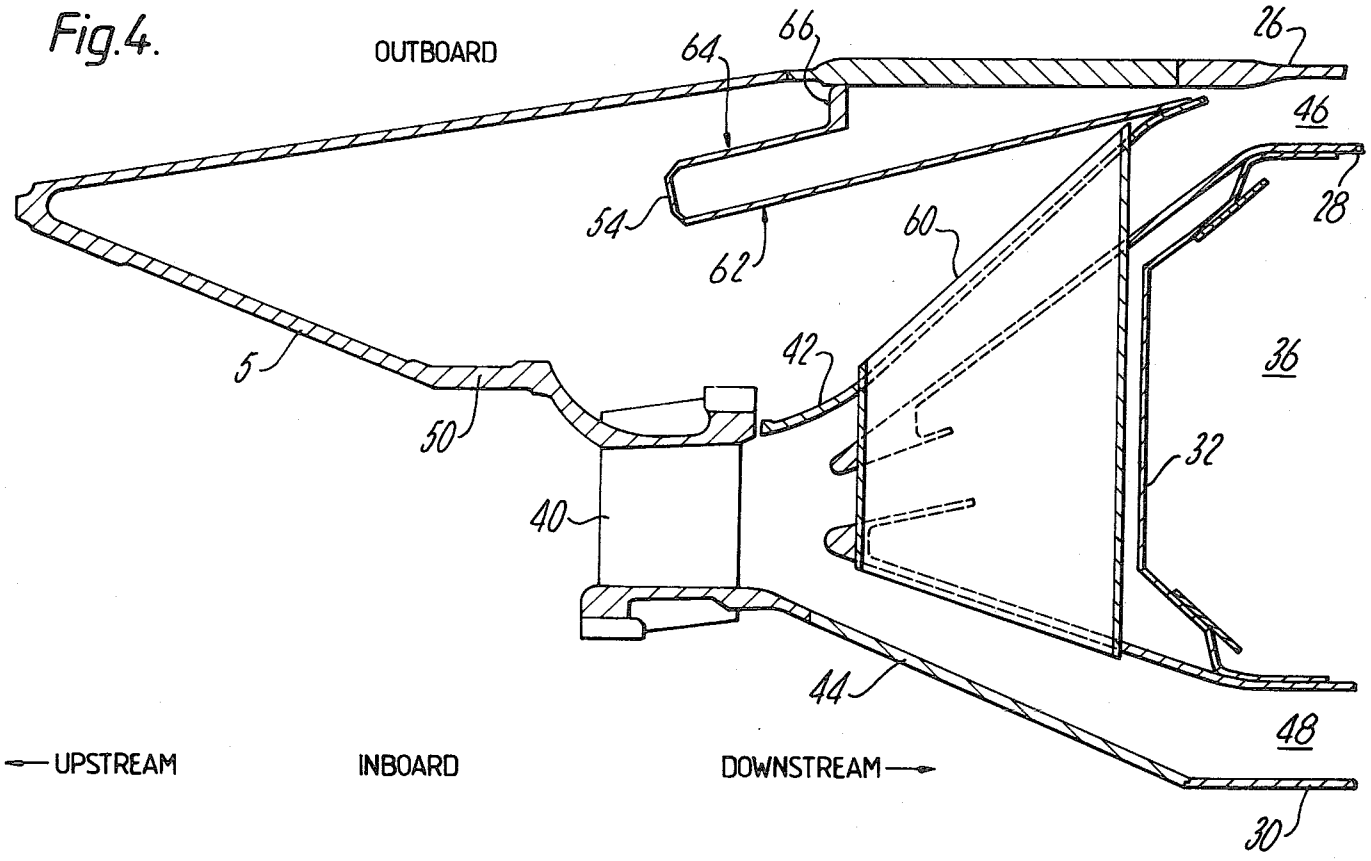
Figure 5:
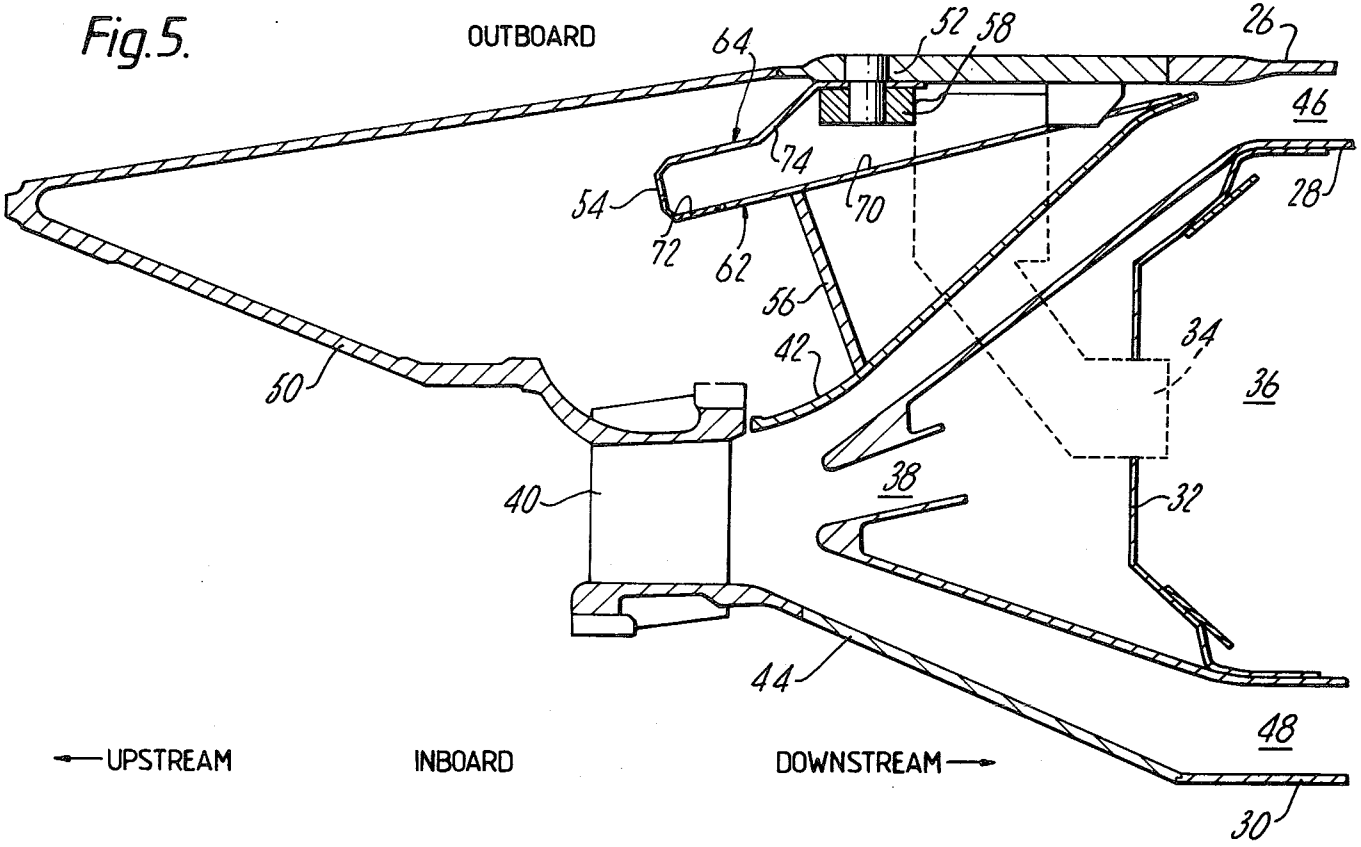
Figure 6:
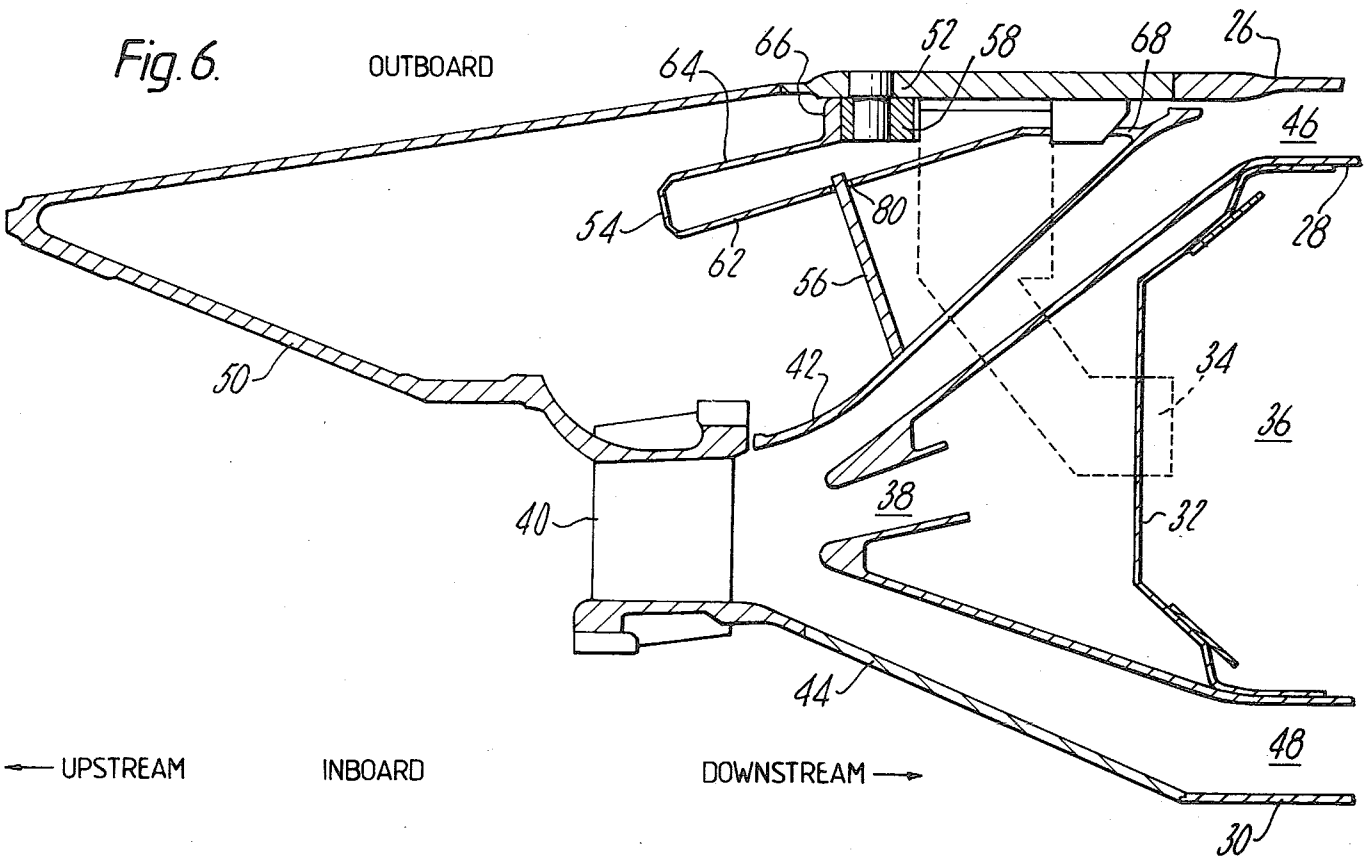

FIG. 3 is a section on line B—B in FIG. 2 showing one embodiment of a mounting arrangement according to the present invention, FIG. 4 is a section along the line C—C in FIG. 2, FIG. 5 is a view similar to that shown in FIG. 3 but showing an alternative embodiment of a mounting arrangement according to the present invention, FIG. 6 is a view similar to that shown in FIG. 3 but showing a further embodiment of a mounting arrangement according to the present invention.

Figure 1:
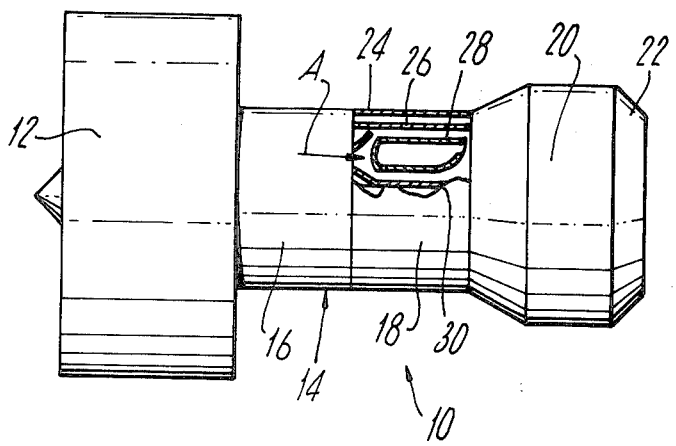
FIG. 1 is a diagrammatic view partly in broken away section of a gas turbine engine showing the combustion equipment.

A gas turbine engine 10, as shown in FIG. 1, comprises in flow series a fan 12 and a core engine 14. The core engine 14 comprises a compressor 16, combustion equipment 18, a turbine 20 and an exhaust nozzle 22. In operation air is drawn into the gas turbine engine 10 and is initially compressed by the fan 12, and the air flow is then divided into two portions. A first portion of the air, called core air flows into the compressor 16 where it is compressed further before it flows into the combustion equipment 18. Fuel injected into the combustion equipment 18 is mixed with the core air, and the fuel and air mixture is burnt to produce hot gases. The hot gases produced by the combustion of the fuel and air mixture flow into and drive the turbine 10 which in turn drives the fan 12 and the compressor 16. The hot gases then leave the gas turbine engine through the exhaust nozzle 22. The second portion of air flows through an annulus around the core engine 14.

The cut-away shows part of the combustion equipment 18 which comprises an outer casing 24, a support casing 26, an annular flame tube 28 and an inner casing 30.

Referring to FIGS. 2 to 4 which show a mounting arrangement for the combustion equipment 18.

The annular flame tube 28 has an air inlet 38 at its upstream end, and a head 32 which has a circumferential arrangement of apertures 34. An airspray fuel burner nozzle is positioned coaxially in each aperture 34 and introduces a fuel and air mixture into the primary zone 36 of the annular flame tube 28. The support casing 26 is spaced radially outboard of the annular flame tube 28 and an outer air passage 46 is defined between the support casing 26 and the annular flame tube 28. Similarly the inner casing 30 is spaced radially inboard of the annular flame tube 28 and an inner air passage 48 is defined between the inner casing 30, and the annular flame tube 28. A number of circumferentially arranged compressor outlet guide vanes 40 direct the compressed air from the compressor 16 into the air inlet 38 of the annular flame tube 28, and into the outer and inner air passages 46 and 48 respectively. An inner diffuser wall 44 extends from the downstream end of the outlet guide vanes 40 to the upstream end of the inner casing 30, and an outer diffuser wall 42 is spaced from the downstream end of the outlet guide vanes 40 and extends in a downstream and an outboard direction towards the support casing 26, but is spaced radially from the support casing.

A cylindrical structure 50 which has a conical cross-section secures the upstream end of the outlet guide vanes 40 to the support casing 26.

The outer diffuser wall 42 is secured to the upstream end of the annular flame tube 28 by a number of struts 60 which extend radially across the outer air passage 46. A number of fairing structures 56 are secured to and extend in an outboard direction from the outer diffuser wall 42 towards the support casing 26 but are spaced radially from the support casing 26.

A relatively flexible support structure which in this case is a relatively flexible ring 54 has a generally U-shaped cross-section and comprises an inboard and an outboard limb 62 and 64 respectively. The ring 54 is positioned radially between the outboard end of the fairing structures 56 and the support casing 26, and the inboard limb 62 of the ring 54 is secured to the outboard end of the fairing structures 56 and also to the downstream end of the outer diffuser wall 42. A flange 66 on the outboard limb 64 of the ring 54 is secured to the support casing 26. In this particular embodiment the inboard limb 62 of ring 54 is secured to the fairing structures 56 and to the outer diffuser wall 42 by brazing, but other suitable methods may be employed, and the outboard limb 64 of the ring 54 is secured by brazing or other suitable methods to a number of burner mounting plates 58 which are secured to a corresponding boss 52 in the support casing 26 by a number of bolts which also secure each fuel burner in position.

The inboard limb 62 has a number of apertures to allow the burners to locate with the annular flame tube 28.

In operation, compressed air from the compressor 16 is directed by the outlet guide vanes 40 to flow into the inlet 38 of the annular flame tube 28 and through the airspray nozzles into the primary zone 36 where the primary air is mixed with fuel from the fuel burner nozzles and the mixture is burnt.

The heat generated by the combustion of the fuel and primary air mixture causes the annular flame tube 28 and the annular support casing 26 to expand radially. When the gas turbine engine 10 is running at for example, cruise operating conditions the annular flame tube 28 and the support casing 26 attain a fixed relationship with respect to each other, but during acceleration and deceleration of the gas turbine engine, that is when the (rate of) heat generation in the annular flame tube is not constant, the annular flame tube 28 expands or contracts at a greater rate than the annular support casing 26.

In many of the present day gas turbine engines the annular flame tube is mounted rigidly to the support casing by means of fairing structures similar to those in FIG. 3, but which extend in a radially outboard direction from the outer diffuser wall to the support casing, and by a number of struts which extend radially from the annular flame tube to the outer diffuser wall. The fairing structures have integral fastener bosses, and a number of bolts secure the integral fastener bosses of each fairing structure and the corresponding fuel burners to a corresponding boss in the support casing.

This rigid securing of the annular flame tube to the support casing results in stresses being introduced into the annular flame tube, the support casing, and especially in the struts and often results in distortion or cracking of the annular flame tube, the outer diffuser wall or the support casing.

The present invention overcomes the problems of distortion or cracking of the annular flame tube 28 or the support casing 26 by positioning the ring 54 between the outboard end of the fairing structures 56 and the support casing 26. The outboard limb 64 of the ring 54 is secured to the support casing 26 and the inboard limb 62 is secured to the fairing structures 56 and to the outer diffuser wall 42, the downstream end of the outer diffuser wall 42 being radially spaced from the support casing 26.

When the gas turbine engine 10 accelerates the annular flame tube 28 expands at a greater rate than the support casing 26 this causes the struts 60 and the outer diffuser wall 42 to move in a radially outboard direction.

The outer diffuser wall 42 is not restricted in its radial movement as there is a space between the downstream end of the diffuser wall 42 and the support casing 26, and the ring 54 which has a generally U-shaped cross-section flexes in order to permit the outer diffuser wall 42 to move in a radially outboard direction. Similarly when the gas turbine engine 10 decelerates the annular flame tube 28 contracts at a greater rate than the support casing 26 and this causes the struts 60 and the outer diffuser wall 42 to move in a radially inboard direction. The outer diffuser wall 42 is not restricted in its radial movement as the ring 54 flexes in order to permit the outer diffuser wall 42 to move in a radially inboard direction.

FIG. 5 is an alternative embodiment of the mounting arrangement in which the mounting is essentially identical to that shown in FIG. 3, but the ring 54 has a modified cross-section. The outer limb 64 of the ring 54 does not have a flange, and the outer limb 64 bends in an outboard direction and abuts the bosses 52 of the support casing 26. The burner mounting plates 58 are brazed to the inboard face of the limb 64 and are secured to the support casing 26 by the bolts which secure the burners 34 to the support casings 26 and which thread into the burner mounting plates 58.

FIG. 6 is a further embodiment of the mounting arrangement in which the mounting is essentially identical to that shown in FIG. 3, but the ring 54 has a further modified cross-section and the outer diffuser wall 42 has been altered. The outer diffuser wall 42 has an arm 68 which extends in an upstream direction from the downstream end of the outer diffuser wall 42, and the inner limb 62 is bent at its downstream end in order for it to abut and be butt welded to the arm 68.

In order to permit greater flexing of the ring 54, the outboard end of the fairing structure 56 extends through a slot 80 in the first limb 62 of the ring 54, and the outboard end of the fairing structure 56 is not secured to the first limb 62. This permits the whole of the first limb 62 of the ring 54 to move freely in a radial direction.

The relatively flexible support structure is fabricated in a number of sections which are secured together by butt welding, but other suitable methods may be employed. The ring 54 shown in FIGS. 3 and 6 is made from two sections, the first section comprises the inboard limb 62 which is made of sheet metal, and the second sections comprises the outboard limb 64 and the flange 66 which is made as a forging.

The ring 54 shown in FIG. 5 is made from three sections, the first section 70 comprises the majority of the inboard limb 62 which is made of sheet metal, the second section 72 comprises the upstream end of inboard limb 62, and the third section 74 comprises the outboard limb 64. The second and third sections 72 and 74 respectively are made as forgings.

We claim:

1. A combustion equipment mounting arrangement comprising:

an annular flame tube;

a support casing spaced radially outboard of said annular flame tube;

a flexible support structure positioned radially between said annular flame tube and said support casing for permitting relative radial movement of said annular flame tube and said support casing, said flexible support structure being U-shaped in section and including a first limb having a downstream end operatively secured to said annular flame tube, and a second limb secured to said support casing;

an outer diffuser wall spaced radially outboard of said annular flame tube, said outer diffuser wall having a downstream end with an integral arm extending in an upstream direction and secured to said downstream end of said first limb of said flexible support structure;

a plurality of struts extending from said annular flame tube to said outer diffuser wall for operatively securing said annular flame tube to said first limb; and a plurality of fairings secured to said outer diffuser wall and extending in a radial direction, said first limb of said flexible support structure having a plurality of slots therein for respectively receiving said plurality fairings without said fairings being secured to said first limb of said flexible support structure.

2. A combustion equipment mounting arrangement as claimed in claim 1 in which the support casing is secured to the second limb of the flexible support structure by a number of bolts which extend through respective bosses in the support casing and secure a burner to a respective burner mounting plate, the burner mounting plate being secured to the second limb of the flexible support structure.

3. A combustion equipment mounting arrangement as claimed in claim 2 in which the outer diffuser wall is spaced radially inboard of the support casing.

4. A combustion equipment mounting arrangement as claimed in claim 1 in which the flexible support structure is completely annular in section.

* * * * *